United States Patent [19]

Beauchamp

[11] 4,216,858

[45] Aug. 12, 1980

[54] WRISTWATCH DISPLAY PACKAGE

[75] Inventor: Roger P. Beauchamp, Harrisville, R.I.

[73] Assignee: International Packaging Corp., Pawtucket, R.I.

[21] Appl. No.: 32,949

[22] Filed: Apr. 23, 1979

[51] Int. Cl.[3] ..... B65D 5/50; B65D 85/40

[52] U.S. Cl. ..... 206/45.15; 206/45.18; 206/301; 206/566; 220/8

[58] Field of Search ..... 206/45.18, 45.15, 566, 206/459, 45.12, 45.14, 44.12, 301, 44, 45.11, 45.13; 220/8

[56] References Cited

U.S. PATENT DOCUMENTS

| | | | |
|---|---|---|---|
| 2,118,507 | 5/1938 | Guttman | 206/45.15 |
| 2,644,259 | 7/1953 | Beadle | 206/459 X |
| 4,005,775 | 2/1977 | Crossle | 206/566 X |
| 4,034,849 | 7/1977 | Zakrajsek | 206/44.12 X |

FOREIGN PATENT DOCUMENTS

| | | | |
|---|---|---|---|
| 2207928 | 8/1973 | Fed. Rep. of Germany | 206/45.14 |

*Primary Examiner*—Allan N. Shoap
*Attorney, Agent, or Firm*—Salter & Michaelson

[57] ABSTRACT

A package for alternatively displaying and enclosing an article such as a wristwatch. The package includes a base, an article holder slidably and removably positioned in the base, and a cover adapted for alternate disposition with respect to the base so as to alternatively provide for relatively open display and for substantially complete enclosure of the article. The package in its enclosure mode can be utilized as a shipping container. In its display mode, the package is utilized to display the article to prospective purchasers and in this mode the relationship of the cover to the base provides a stop means whereby the slidable removal of the article holder, and accordingly the article, to those unfamiliar with the operational manner of the package is prevented, and accordingly provides a measure of security for the retailer using this package.

21 Claims, 9 Drawing Figures

WRISTWATCH DISPLAY PACKAGE

BACKGROUND AND SUMMARY OF THE INVENTION

This invention relates to a package that can be used to display articles to prospective purchasers. More particularly, the package has applicability for the alternative display and enclosure of articles having a closed loop configuration such as a bracelet, wristwatch, and the like.

Although packages constructed for the alternate enclosure and display of articles such as wristwatches and the like are known, a recurrent problem with such devices is that they generally do not offer any effective barrier for the prevention of the removal of the articles displayed therein by prospective purchasers. Also, when such safety means are provided, they are either cumbersomely constructed, or, if not, their operation becomes too obvious when the salesperson removes the wristwatch or similar article to demonstrate same for the purchaser.

A further desirable feature of a package of this type would be that it could be held by the prospective purchaser so that he or she could get the "feel" of the merchandise and still not be able to easily remove the article from the package so as to accordingly reduce incidental thefts of merchandise short of the person taking the entire package and the contents thereof. Another common drawback of known package constructions is that although many provide cover and base portions, no interrelationship exists between such cover and base portions so as to enhance the function of the package as a whole.

It is accordingly an object of the present invention to provide a package of the aforementioned general type in which the cover and base portions interrelate in such a manner so that the package may be utilized in an attractive display mode and yet alternatively function as a shipping container or mailing package for the articles displayed and contained therein.

A further object of the present invention is the provision of a package having base and cover portions which interrelate in such a manner that the cover portion functions as a stop means in the package display mode such that an article holder slidably disposed within the base portion may not be removed and thus provide a safety or anti-theft feature to the package.

A still further object of the present invention is the provision of a package having a base with which a slidable article holder is associated such that articles having a closed loop configuration, such as wristwatches and the like, may be easily displayed in an attractive upright setting, yet the article holder and the article supported thereby may be easily removed as a unit for closer examination of the article by the customer.

These and other objects of the invention are accomplished by the provision of a package including base and cover portions adapted to essentially nest with each other in an open display mode and co-act in the enclosure mode so as to form a closed package suitable for shipment and storage. An article holder is associated with the base and is adapted to pivotably slidably move into and out of an access opening provided in the front face thereof. The overall configuration of both the base and cover portions is box-like and both the cover and base are of a similar shape, such that the cover may be superimposed over the base in such a manner that the two components appear as a single unit. In this regard both the base and cover components are provided with a front wall of minor vertical extent and rear wall of major vertical extent such that the cover front wall is disposed in face-to-face position with the base rear wall and the cover rear wall in part serving to enclose the front access opening provided in the base when the package is in its enclosure mode. In the display mode, the cover essentially is superimposed upon the base with the front wall thereof serving to prevent the outward movement of the article holder from the front access opening of the base.

Other objects, features, and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
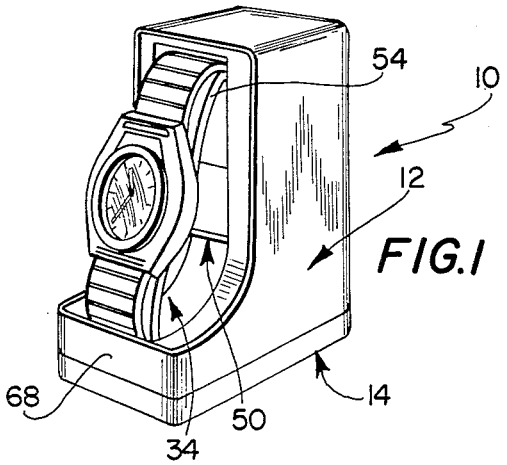
FIG. 1 is a perspective view showing the package construction of the present invention disposed in its generally open display mode such that an article such as the wristwatch shown may be displayed to prospective customers in an apparent open manner yet providing some measure of anti-theft protection.
Figure 2:
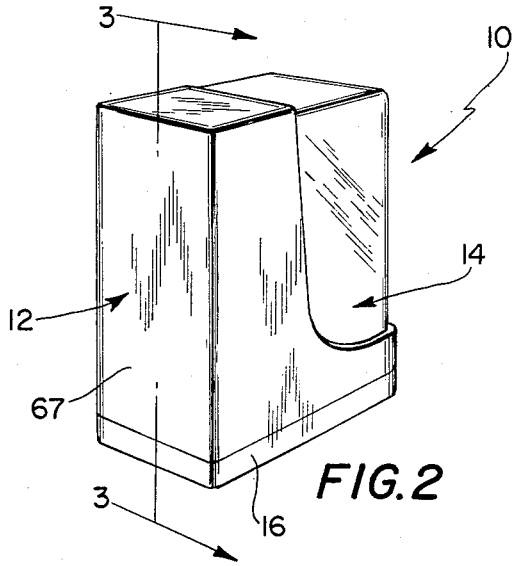
FIG. 2 is a perspective view similar to FIG. 1 but showing the cover portion thereof upwardly removed, rotated 180°, and thereafter disposed in its alternate position with respect to the base so as to form the enclosure mode of the package.

Turning now to the drawings and particularly FIG. 1 thereof, the package 10 of the present invention is shown in its open display mode wherein the cover 12 is disposed in superimposed position over the base 14. From such view it may be apparent that the cover and base are both of essentially the same or similar configuration, but that the cover is of slightly larger dimensions such that it may be disposed over the base in the manner depicted. Alternatively, the cover and base may be disposed with respect to each other to form an essentially fully enclosed package such as shown in FIG. 2 of the drawings.

The base and cover components are generally of hollow box-like configuration. The base includes a peripheral platform or supporting pad 16 terminating in a peripheral flange or ledge 18 from which the base proper upwardly extends. Such base includes opposed sidewalls 20, a top wall 22, a rear wall 24 serving to interconnect said sidewalls and said top wall together, and front wall 26 of minor vertical extent and formed by laterally spaced front wall portions 28. Each of sidewalls 20 is roughly of a L-shaped configuration wherein the rear wall 24 is the stem, the top wall the top, and the front wall the front of said L-configuration. The sidewalls terminate at the forward extent thereof in a front edge 30 having a downwardly forwardly curve and terminating at the front wall portions 28. A pair of face walls 32 inwardly extend towards each other from the side edges 30 and terminate in spaced relationship to each other so as to define a front access opening 34. Such face walls 32 thus form extensions of said sidewalls and accordingly may be considered portions thereof.

The lower end of such access opening 34 is provided with secondary sidewalls 36 downwardly extending from the inner terminal edge of the front faces 32 and at the upper end thereof with an upper secondary sidewall portion 38. Each of the lower secondary sidewalls 36 is provided with an inwardly extending ledge 40 of generally L-shaped configuration. Each of the upper secondary sidewalls 38 is provided with a pair of inwardly extending ledges 42 to form an undercut slot 44 having an open bottom both for a purpose which will hereinafter be more evident. The base 14 is usually formed without a bottom wall for ease in molding, however, that area at the bottom of the access opening 34 generally corresponding with or forming a continuation of the ledge 18 is provided with a rearwardly extending tongue 46 connected at the front thereof to such ledge and inwardly terminating in a lateral edge 48.

The base 14 is adapted to receive an article holder 50 having a generally planar foot 52 to which a generally C-shaped upwardly extending loop 54 is connected by means of a connecting wall 56 at one side thereof. The other side of the foot is purposefully left open so as to form an open slot 58 between the upper surface of the foot 52 and the lowermost segment of the loop 54. The article support foot 52 is also provided with an upstanding forwardly disposed face plate 60. In addition, pivot means are included in the loop segment 54 in the form of a pair of laterally spaced upstanding ears 62 at the upper extent thereof, that is, the cooperation of the ears 62 and the slots 44 form such pivot means. It may thus be apparent that an article having a closed loop portion such as the supporting wristband of a wristwatch may be disposed over the loop segment 54 and supported thereby as in the fashion illustrated in FIG. 1. The open slot 58 serves to facilitate laterally sliding such wristwatch band or other closed loop article onto and around the supporting surface of the segment 54, said loop normally being expandable so as to clear ear 62. The foot 52 also includes a rearwardly disposed downwardly extending heel portion 64 forming a ledge 66 at the forward portion thereof.

Figure 4:
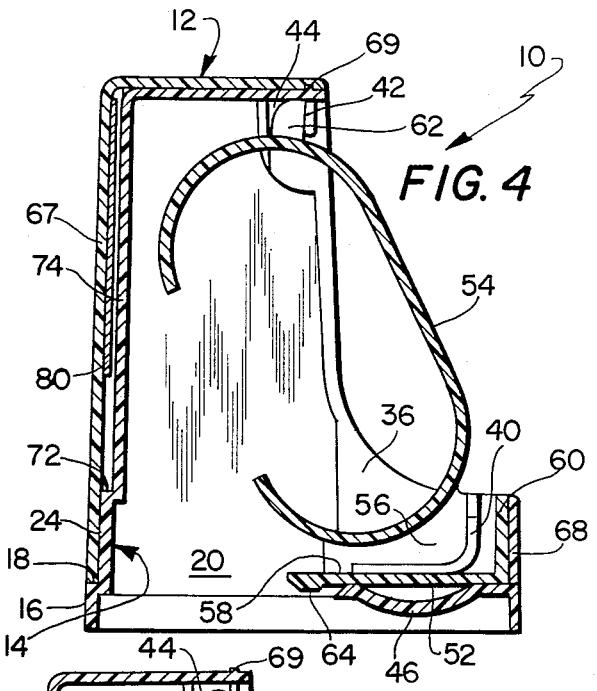
FIG. 4 is a side elevational view similar to FIG. 3 but showing the cover portion disposed in its open display mode.
Figure 5:
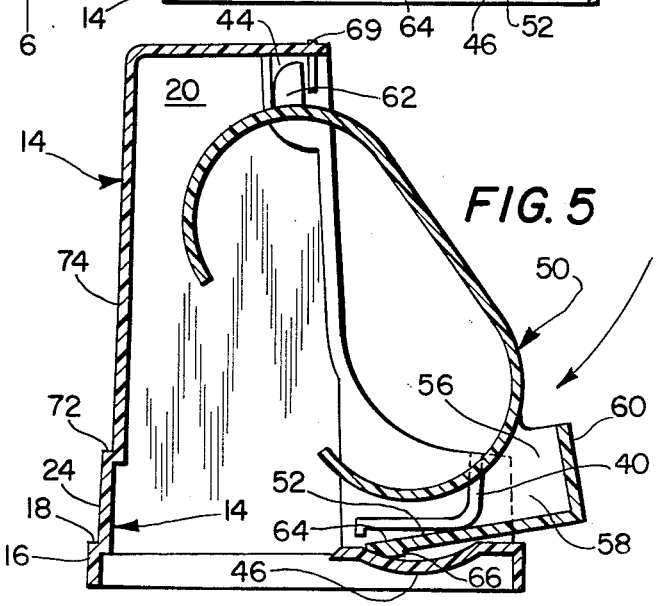
FIG. 5 is a side elevational view similar to FIG. 4 but showing the manner in which the article holder is removably slidably positioned with respect to the base, the cover having been removed for such purpose.
Figure 6:
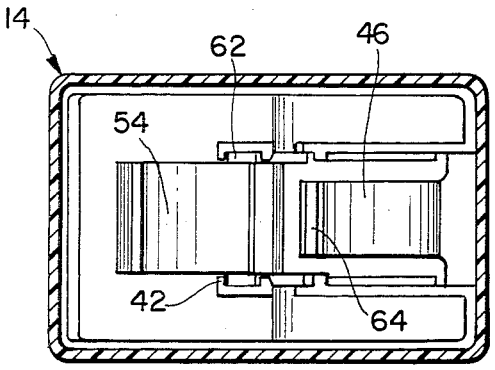
FIG. 6 is a sectional bottom view taken along the line 6—6 of FIG. 3.

In operation, the article holder 50 is adapted to be slidably positioned into and out of the base 14 through the front access opening 34 thereof. Initially, the holder 50 is manipulated to a position as shown in FIG. 5 wherein the ears 62 thereof are positioned in the open-bottomed slots 44 so as to fixedly position the upper portion of the holder 50 with respect to the base and thereafter the remaining lower portions of the holder may be pivotably swung about such pivot means by forcing such lower portions rearwardly into the access opening 34. In such reagrd, the heel portions 64 of the foot 52 are adapted to engage the tongue 46 so as to downwardly flex the same as the holder moves into the access opening 34. At the same time, lateral edge portions of the foot 52 are adapted to engage beneath the inwardly extending ledges 40 so as to further guide the pivotal movement of the holder and to ensure against the removal of the holder through the access opening except by the reverse of the above described pivotal movement. When the article holder has been fully disposed within the accesss opening 34 as by the alignment of the from plate 60 with the front wall portions 28, the heel 64 rides over the terminal edge 48 of the tongue such that the ledge 66 coacts therewith so as to provide a positive stop. It should be borne in mind, however, that when it is desired to fully or more closely examine the watch disposed on the article holder 50, the article holder and the watch supported thereon can be simply removed from the base by the aforementioned reverse pivotal movement, a downward movement of the rear end of the tongue facilitating such movement. In such display position as illustrated in FIG. 4, it should also be clear that the watch cannot be removed from its position within the base except by removing the article holder on which it is supported since there is not room enough between the edges of the loop segment 54 and the terminal edges of the front faces 32 of the secondary walls 36. In addition, the positioning of the ears 62 within the undercut slots 44 prevents such removal.

Figure 9:
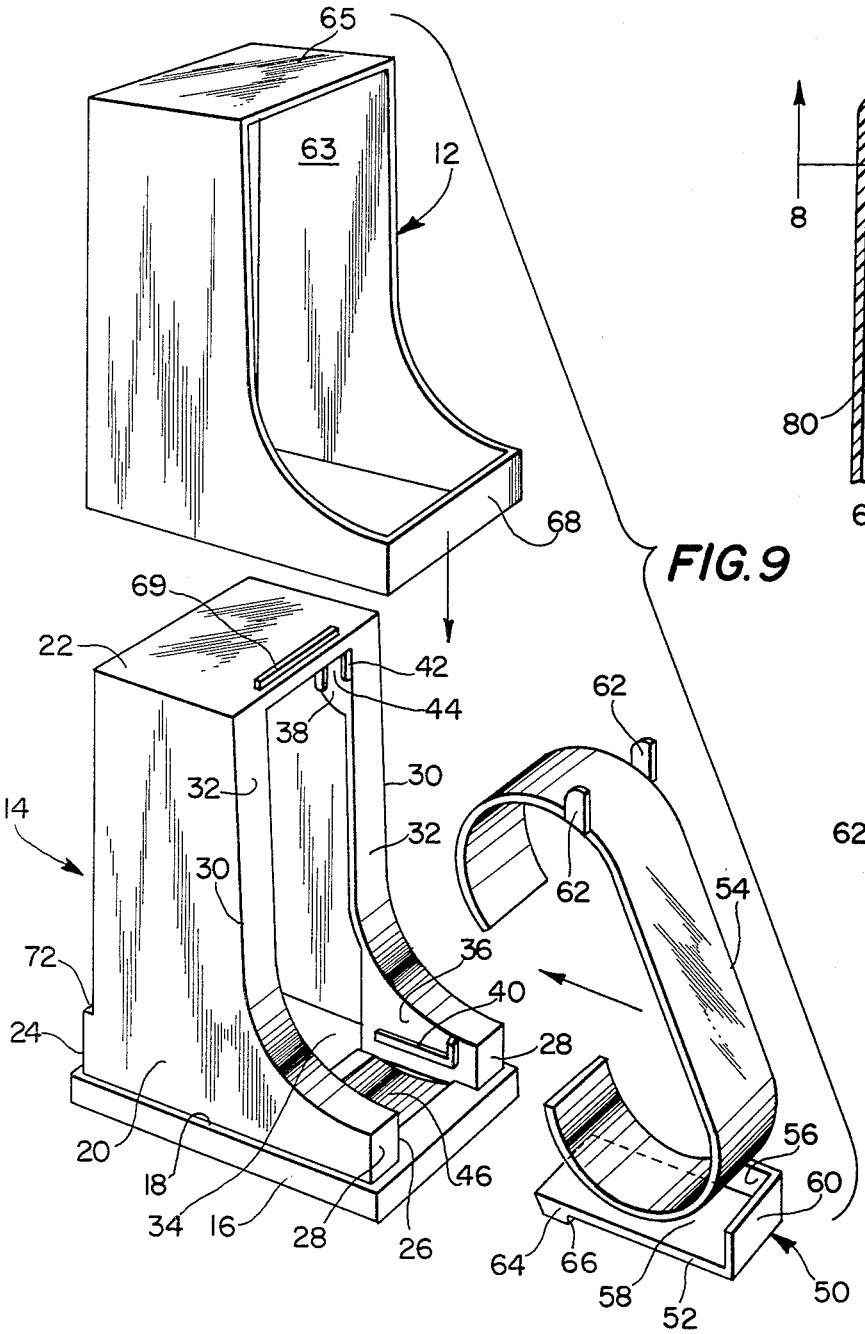
FIG. 9 is an exploded prespective view showing the particular manner in which the package of the present invention functions in its display mode.
Figure 7:
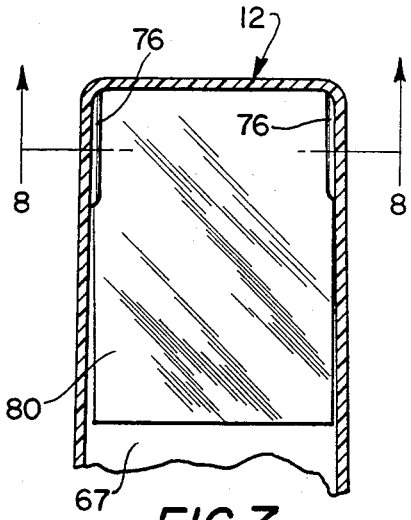
FIG. 7 is a partial sectional view taken along the line 7—7 of FIG. 3.
Figure 8:
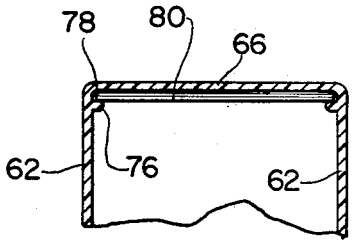
FIG. 8 is a partial sectional view taken along the line 8—8 of FIG. 7.

Turning now to the construction of the cover 12, such is also of hollow box-like configuration and of a shape similar to the outside dimensions of the base 14, but slightly larger in size such that the cover 12 may be disposed thereover. The cover includes opposed sidewalls 63, a top wall 65, a rear wall 67, and a front wall 68. The extent of the rear wall 67 is such that it connects both the sidewalls 63 and the top wall 65 together while the vertical extent of the front wall 68 is drastically foreshortened and generally conforms in height to the front wall portions 28 of the base 14. It may thus be apparent that the cover 12 may be superimposed upon the base 14 in the display mode as shown in FIGS. 1, 4, and 9 such that the top, rear, front, and sidewalls of the cover are disposed face-to-face with the equivalent walls of the base, that is, the cover sidewalls 63 are disposed face-to-face with the base sidewalls 20, the cover rear wall 67 is disposed face-to-face with the base rear wall 24, and the cover top wall 65 is disposed face-to-face with the base top wall 22. In addition, the cover front wall 68 is disposed adjacent to and in face-to-face disposition with the front wall portions 28 but further extends entirely across the lower front of the access opening 34. In this manner then, the central or intermediate portions of the cover front wall 68 are disposed face-to-face or in contact with the front face plate 60 of the article holder 50 so as to prevent its forward movement in the display mode of the package 10 and accordingly forms an effective barrier or stop means whereby the article holder cannot be readily removed from the base in such mode. Such stop means is not immediately noticable to those unfamiliar with the construction of the package such that it forms an effective anti-pilferage feature. Accordingly, unauthorized removal of the article holder and the wristwatch supported thereon is prevented. Thus when a customer desires to more closely examine the watch, the salesperson may swiftly remove the cover and in an unobvious manner withdraw the watch and its article support and permit the prospective customer to examine such under his or her observation, but without the customer noticing what, if any, barrier normally exists to the removal of the article from the base in such display mode.

Figure 3:
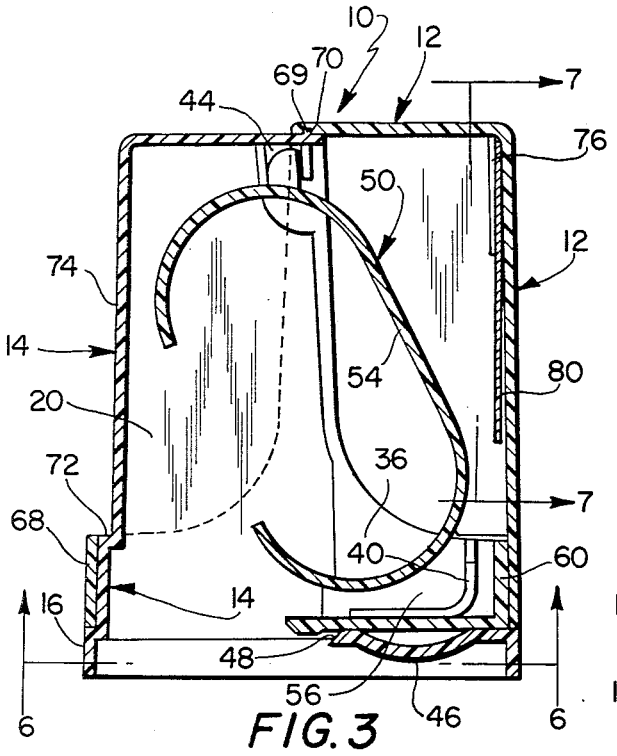
FIG. 3 is a side elevational view taken along the line 3—3 of FIG. 2.

In may instances it is also desirable to utilize the package as a shipping or storage sontainer and such enclosure mode is depicted in FIGS. 2 and 3 of the drawings. When it is desired to change from the display mode to the enclosure mode, the cover 12 is upwardly withdrawn from the base, rotated 180°, and thereafter is disposed over the base such that the sidewalls, the top wall, and the rear wall (63, 65, and 67, respectively) of the cover 12 serve to fully enclose the cut-away display face of the base 14. In this regard it should be pointed out that the cover front wall 68 is adapted to contact the lower portions of the base rear wall 24 so as to insure correct positioning of the cover with respect to the base. Also, in this regard to top wall 22 of the base is provided with a laterally extending detent 69 which is adapted to mate with a similarly shaped groove 70 provided in the undersurface of the cover top wall 65. This interaction between detent 69 and groove 70 is present in both the display and the enclosure modes of the package as shown most clearly in FIGS. 3 and 4. To accomplish this purpose and so as to further provide a cover which may be superimposed upon the base, the depth of both the cover top wall 65 and the base top wall 22 are approximately equal and each approximately one-half the depth of their respective side walls.

As it may be desirable upon occasion to incorporate instructional or warranty pamphlets with the wristwatch package 10 of the present invention, the rear wall 24 of the base is provided with a forwardly directed step 72 such that the upper portions 74 of the rear wall are spaced from the inner surface of the cover rear wall 67. The cover sidewalls are additionally provided with a pair of vertically extending inwardly directed ears 76 so as to in effect define a vertical slot 78 between such ears and the rear wall 67. A pamphlet or other article 80 of generally flat, thin overall planar construction may be slipped behind such ears 76 and maintained within the slot 78 by frictional engagement. The forwardly directed step 72 provided in the rear wall 24 of the base 14 serves to provide the necessary space to accomodate the added thickness of such article 80.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A package for alternatively displaying and enclosing an article such as a wrist watch comprising, a base, an article holder disposed in said base and a cover adapted for alternate disposition with respect to said base so as to accomplish the display and enclosure modes, said base of substantially box-like configuration having top, front and rear walls interconnected by a pair of opposed laterally spaced sidewalls, said sidewalls of a somewhat L-shaped configuration such that said top wall forms the top of said L-configuration, the front wall forms the lower forward extremity thereof, and the rear wall forms the stem thereof, said walls cooperating to form a combined article display area and a centrally disposed front access opening for said article at a front face thereof located on the same side of the base as said front wall, said access opening further defined by edge portions of said sidewalls which are laterally spaced from each other, said cover of essentially similar configuration as said base including a front access opening disposed at the front face thereof, said cover being of slightly larger dimensions such that said cover is adapted to fit over said base in said display position wherein the respective top, front, rear and sidewalls of both said base and said cover are disposed face to face with each other with the access openings in registration thereby allowing access to the article display area, said cover further adapted for 180° rotation for disposition over said base in said enclosure mode wherein said cover front and rear walls are respectively disposed face to face with said base rear and front walls and wherein said cover top, rear and sidewalls are disposed over the front face of said base so as to enclose the same thereby preventing access to the article display area.

2. The package construction of claim 1 wherein portions of said top and sidewalls of both said base and said cover partially overlap each other in said enclosure mode while essentially completely overlapping each other in said display mode.

3. The package construction of claim 1, said article holder slidably positioned in said base for relative movement into and out of said front access opening such that the article holder may be completely separated from said base when said cover is removed from said base.

4. The package construction of claim 3, said cover front wall forming stop means for preventing removal of said article holder from said base when said cover and said base are disposed in said display mode.

5. The package construction of claim 4, including means at the upper end of said access opening for pivotably engaging upper portions of said article holder whereby bottom portions of said holder may slidably swing into and out of said access opening, said cover front wall preventing such swinging movement when said package is disposed in said display mode.

6. The package construction of claim 3, including means for locking said article holder to said base.

7. The package construction of claim 6, said article holder including pivot means at the upper end thereof for engaging portions of said base at the upper end of said front access opening whereby the bottom of said holder may be rearwardly pivoted into said access opening and into engagement with said locking means.

8. The package construction of claim 7, said locking means including a downwardly movable tongue rearwardly projecting from the bottom front portion of said access opening, said holder having a bottom foot adapted to slidably contact said tongue, said foot having a downwardly directed detent adapted to ride over the inner terminal edge of said tongue.

9. The package construction of claim 8, said pivot means including a pair of spaced ears upstanding from said holder, said ears adapted for respective positioning into a pair of open bottom, undercut slots disposed on either side of said access opening.

10. The package construction of claim 1, said base having an outwardly projecting bottom peripheral ledge, the bottom terminal peripheral edge of said cover adapted to rest on said ledge.

11. The package construction of claim 1, said base and cover top walls having relative positioning means.

12. The package construction of claim 1, said article defining a closed loop structure, said article holder having a bottom foot and an upstanding loop support, said loop connected to said foot at one lateral side thereof so as to define an access opening for said loop at the other side thereof.

13. The package construction of claim 8, said article defining a closed loop structure, said foot having an upstanding loop support connected thereto at one lateral side thereof so as to define an access opening for said loop at the other side thereof.

14. The package construction of claims 3, or 5, said base including laterally spaced front face walls inwardly projecting from said forward side edge portions so as to define said front access opening therebetween, said front face walls further including secondary side walls supporting the means by which said article holder may be slidably moved into and out of said access opening.

15. The package construction of claim 1, upper portions of said base rear wall and said cover rear wall adapted to be spaced from each other when said package is in its display mode.

16. The package construction of claim 15, said cover sidewalls having a pair of laterally inwardly projecting vertically extending ears slightly forwardly spaced from said cover rear wall whereby a planar article such as an instructional sheet may be disposed therebehind.

17. A package for displaying an article such as a wristwatch comprising a base and an article holder disposed in said base, said base of substantially box-like configuration having a front wall and a top wall in turn connected by means of a pair of opposed laterally spaced sidewalls, said sidewalls of a somewhat L-shaped configuration such that said top wall forms the top of said L-configuration and said top wall is generally horizontally disposed and the front wall forms the lower forward extremity thereof, said walls cooperating to form a combined article display area and a centrally disposed front access opening for said article, said access opening further defined by pivot support means adjacent edge portions of said sidewalls and adjacent said top wall, said article holder including pivot means at the upper end thereof for engaging said pivot support means, the bottom of said holder being in engagement with and rearwardly slidably movable on a lower, upwardly facing surface adjacent said front wall for movement into said access opening by pivoting of said pivot means.

18. The package construction of claim 17, including means for locking said article holder into said base, said locking means including a downwardly movable tongue rearwardly projecting from the bottom front portion of said access opening, said holder having a bottom foot adapted to slidably contact said tongue, said foot having a downwardly directed detent adapted to ride over the inner terminal edge of said tongue.

19. The package construction of claim 17, said pivot means including a pair of spaced ears upstanding from said holder, said ears adapted for respective positioning into a pair of open bottom undercut slots disposed on either side of said access opening.

20. The package construction of either claims 9 or 19, said article defining a closed loop structure, said article holder having a bottom foot and an upstanding loop support, said ears disposed on either side of said loop support such that said article is locked thereon when said ears are disposed in said slots.

21. The package construction of claim 19, said article defining a closed loop structure, said article holder having a bottom foot and an upstanding loop support, said loop connected to said foot at one lateral side thereof so as to define an access opening for said loop at the other side thereof.

* * * * *